United States Patent [19]

Almeras et al.

[11] Patent Number: 4,824,003

[45] Date of Patent: Apr. 25, 1989

[54] INDIRECT FIRING FASTENER DRIVING TOOL

[75] Inventors: Roland Almeras, Tournon; Jean-Claude Vernerey, Bourg-les-Valence, both of France

[73] Assignee: Societe De Prospection Et D'Inventions Techniques S.P.I.T., Paris, France

[21] Appl. No.: 135,121

[22] Filed: Dec. 18, 1987

[30] Foreign Application Priority Data

Dec. 23, 1986 [FR] France ..... 86 18018

[51] Int. Cl.[4] ..... B25C 1/14

[52] U.S. Cl. ..... 227/10; 267/137; 267/140; 248/562; 248/636; 173/139

[58] Field of Search ..... 173/139; 248/562, 636; 227/10, 147; 267/116, 118, 137, 140

[56] References Cited

U.S. PATENT DOCUMENTS

| | | | |
|---|---|---|---|
| 2,879,986 | 3/1959 | Maier | 267/1 |
| 3,080,159 | 3/1963 | Orner | 267/1 |
| 3,179,185 | 4/1965 | O'Farrell | 173/139 X |
| 3,465,942 | 9/1969 | Diehl et al. | 227/10 |
| 3,490,673 | 1/1970 | Diehl et al. | 227/10 |
| 3,566,978 | 3/1971 | Udert | 173/139 |
| 3,636,707 | 1/1972 | Saari et al. | 60/51 |
| 3,746,235 | 7/1973 | Crabtree, Jr. | 227/10 |
| 3,969,989 | 7/1976 | Maurer et al. | 92/85 R |
| 4,122,987 | 10/1978 | Jochum et al. | 227/10 |
| 4,206,687 | 6/1980 | Klaus et al. | 91/395 |

FOREIGN PATENT DOCUMENTS

| | | |
|---|---|---|
| 447009 | 1/1972 | Australia . |
| 1478838 | 11/1965 | Fed. Rep. of Germany . |
| 1812207 | 12/1968 | Fed. Rep. of Germany . |
| 1344304 | 9/1962 | France . |
| 1343321 | 1/1963 | France . |
| 1355370 | 5/1963 | France . |
| 2171205 | 9/1973 | France . |
| 934082 | 8/1963 | United Kingdom . |

*Primary Examiner*—Frank T. Yost
*Assistant Examiner*—James L. Wolfe
*Attorney, Agent, or Firm*—Thomas W. Buckman; Neal C. Johnson

[57] ABSTRACT

An indirect firing fastener driving tool is provided including a barrel (51), a piston (6) sliding in the barrel for driving a fastener (3) housed in a fastener guide (7). Between the barrel (51) and the fastener guide (7) are disposed a rigid ring (22) and a resilient ring (24). Inside the resilient ring (24) is disposed a rigid ring (27) for limiting the stroke of the ring (22) intended to be received in a recess (25) provided at the rear part of the fastener guide (7). The head (14) of the piston is of a truncated cone shape and may cooperate with a bore (23) of corresponding shape in the rigid ring (22). The rings serve as absorber for the piston (6) whose stroke is thus controlled.

13 Claims, 2 Drawing Sheets

INDIRECT FIRING FASTENER DRIVING TOOL

BACKGROUND OF THE INVENTION

1. Field of the Invention

The present invention relates to an indirect firing fastener driving tool, including a piston mounted in a barrel for, under the action of the combustion gases of a propulsive charge, driving a fastener for fixing a work piece on a support, means for absorbing the piston being provided between the barrel and a fastener guide disposed in front of the barrel, for absorbing the excess propulsion energy of the piston and limiting its stroke, the absorbing means comprising, in combination, a ring, arranged for cooperating with the head of the piston, a first intermediate ring, made from a resilient material, disposed between the ring cooperating with the piston head and the fastener guide, and a second intermediate ring, made from a rigid but slightly deformable material, movable axially between the ring cooperating with the piston head and the fastener guide.

2. Description of the Prior Art

Fastener driving tool of this type are often used for boarding buildings, such as sheds. It is a question, for example, and using short fasteners, of fixing metal covering sheets on beams having for example an I section. Generally, the thicknesses of the support materials receiving fixing fasteners are variable from one material to another, and the regularity of driving the fasteners into these materials must be ensured. To take the example of I section beams, to be covered with metal sheets of small thickness, it frequently happens that the operators work blind, without knowing whether they are firing into the web of the beams, into their side flanges of small thickness, or even to the side. If it is in the flanges, the fasteners would risk being driven in too far, which would be prejudicial to the fixing quality, but if it is to the side, they could pass through the small thickness metal sheets in the manner of a veritable projectile propelled at a speed which is still high, if the driving tool were not in fact provided with means for absorbing the piston which limit its stroke, without mentioning tools which are based on the absorbtion of the excess power by driving in the fastener itself, and in which the piston may project out of the fastener guide.

The absorber for the piston is therefore intended to limit or control the stroke thereof. In fact, it is sufficient to ensure the position of the piston at the time when, so to speak, it releases the fastener for, at this time, the kinetic energy of the fastener only represents a very small portion of the propulsion energy, which is insufficient for it to continue its driving stroke. In other words, as soon as the fastener is released by the piston, it stops.

Several types of absorbers are already known, non elastic steel rings on the one hand and resilient material rings, for example made from polyurethane, on the other.

Steel rings offer the advantage of good driving precision, but they have the drawback of increasing the risks of breakage of the piston by sudden stopping. Resilient rings do not have this drawback. But because they are frequently driven with considerable force, they become deformed and even break up to the detriment of the positioning accuracy of the piston and the operation of the tool.

From U.S. Pat. No. 3,465,942, a driving fastener tool of the above mentioned type is known. However, in the tool of this document, the second intermediate ring acts only to avoid the first intermediate ring to flow along the piston. The assembly of these two absorbing rings of this document does not enable to determine with a very good accuracy the axial position of the piston after firings.

SUMMARY OF THE INVENTION

The present invention provides then an indirect firing fastener driving tool in which the axial position of the piston after firing is always the same.

For this, the present invention provides an indirect firing fastener driving tool of the above mentioned type, characterized in that the fastener guide and the second intermediate rigid ring are arranged so that the length of the axial displacement of this intermediate ring is equal to the reduction of the axial dimension of the intermediate resilient ring after compression.

The ring cooperating with the piston head may begin to absorb a certain portion of the propulsive energy, by brake-locking, before moving forwards and comressing the first intermediate resilient ring between it and the fastener guide, without the risk of causing breakage of the piston.

The first intermediate resilient ring first enables to limit forward displacement of the ring cooperating with the piston head. This first intermediate resilient ring acts also as a compression spring with turns. And to avoid this spring to deteriorate, the second intermediate rigid ring, bearing against the fastener guide, ensures an abutment function to avoid the turns of this so-called spring to get contigous. In other words, the intermediate rigid ring enables to control the deformation of the intermediate resilient ring and avoids the latter to be disaggregated by an excessive crushing. The intermediate rigid ring takes the energy in excess which has not been already absorbed by the intermediate resilient ring. Still in other words, the intermediate rigid but slightly deformable ring protects the resilient ring which therefore may recover all its features, even after many absorbing strokes of the piston, this being profitable to the accuracy of the positioning of the piston.

Functionally speaking, and so to speak, the two intermediate rings have the same dynamic axial dimension.

In the preferred embodiment of the tool of the invention, the fastener guide comprises a back recess for receiving the second intermediate rigid ring of which the axial depth is at least equal to the reduction of the axial dimension of the intermediate resilient ring after compression.

In this case, it is advantageous that the two intermediate rings have the same axial dimension.

The association of two rings of same axial dimension has the advantage of the mounting simplification, because positioning and way of mounting do not have to be respected. The two rings constitute a non dissociable absorbing assembly which can be changed easily and which can guaranty the positioning of the piston, when it comes at the end of its stroke and which thus enables always a fastening of good quality.

Preferably, the ring cooperating with the piston head is made from rigid material.

Advantageously, an annular space is provided around the two intermediate rings to allow, under the action of displacement of the ring cooperating with the piston head, expansion of the first intermediate resilient ring, up to the moment when the second intermediate rigid and deformable ring abuts against the back bottom or face, of the fastener guide. In this case, the length of the axial displacement of the intermediate rigid ring and the volume of the space surrounding the two intermediate rings may be such that, at the end of the step of deformation of the intermediate resilient ring, when the intermediate rigid ring abuts against the back bottom of the fastener guide, said volume is not null.

Preferably, the head of the piston is hollowed for receiving the charge holder, whereby the robustness of the piston remains intact despite the reduction of its weight which promotes good absorbing thereof.

Advantageously, the sum of the axial lengths of the ring cooperating with the piston head, of the intermediate resilient ring, in its compressed state, and of the fastener guide, on the one hand, as well as the length of the front part of the piston intended to project out of the intermediate resilient ring, on the other, are such that the front end of the piston, after firing, does not project from the fastener guide.

Still preferably, the head of the piston of the tool of the invention is in the form of a truncated cone, so of a large area, and the ring cooperating with the piston head includes a bore of corresponding shape, which offers the best solution to the absorbing problem raised.

BRIEF DESCRIPTION OF THE DRAWINGS

The invention will be better understood from the following description of the preferred embodiment of the sealing apparatus, with reference to the accompanying drawings in which.

DESCRIPTION OF THE PREFERRED EMBODIMENT

Figure 1:
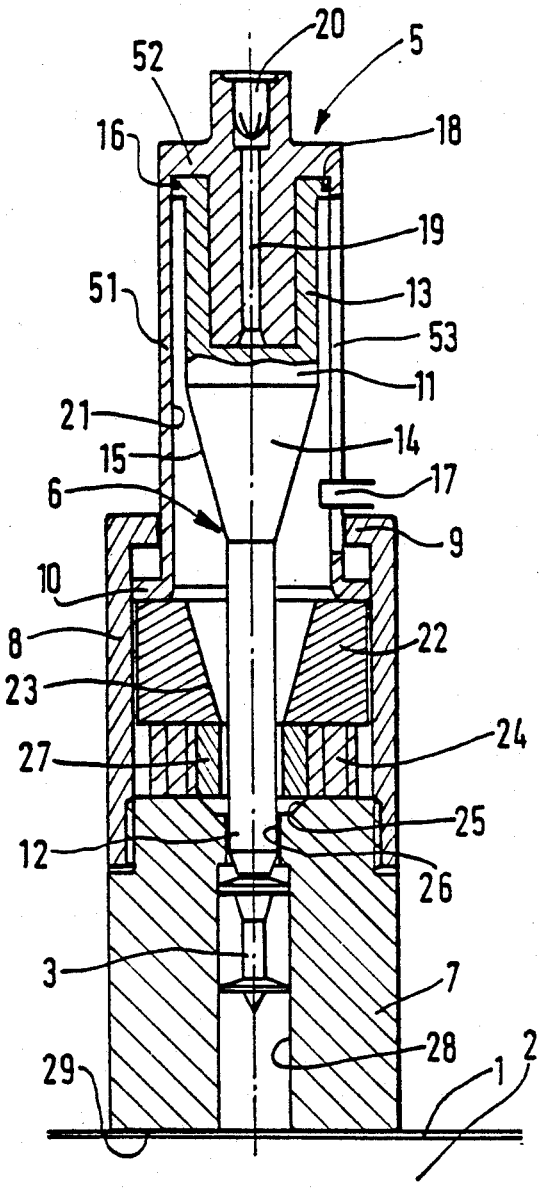
FIG. 1 shows a schematical axial sectional view of the tool of the invention, before firing.

The fastener driving tool which will be described serves especially for fixing work pieces, 1, such as metal covering sheets, on supports 2, such as shed beams, using fasteners advantageously in the form of nails with a short shank 3 and a large head 4.

Since such a tool, apart from its elements related to the invention itself, are perfectly known by a man skilled in the art, only these latter elements will be described.

The tool of the invention includes then a barrel assembly 5, in actual fact a barrel 51 properly speaking and a charge holder 52 integral with the barrel, in which is mounted for axial sliding a piston or inertia block 6 and a fastener guide 7. A flanged spacer 8, integral with the fastener guide 7, has at the rear an internal annular flange 9 for cooperating with an annular external flange 10 with which the barrel 51 is provided at the front so that, during opening of the tool after firing and before loading with a new propulsive charge, the driving forward of the fastener guide 7 takes with it the barrel assembly 5, while, at the time of firing and under the action of the exhaust gases, allowing the recoil of barrel 51 until its front flange 10 abuts against the rear flange 9 of the spacer 8.

Piston 6 has a head 11 and a rod 12. The head 11 includes a rear annular part 13, hollowed out for receiving the charge holder 52 in the closed position of the tool and so ready for firing, and a front truncated cone shaped part 14, widening out rearwardly and having a relatively extended area 15.

The rear of head 11 of the piston has an external collar 16, by means of which piston 6 slides in barrel 5, and which is intended to cooperate with a retainer pawl 17 integral with the barrel holder, not shown, in which the barrel is slidably mounted, pawl 17 being slidable in a slit 53 formed in the barrel. On opening the tool after firing, collar 16 of piston 6 remains in abutment against pawl 17, which prevents the piston 6 from being driven forwardly also. In this respect, it will be noted that an annular groove is formed in the collar 16 for receiving a keeper ring 18 for cooperating frictionally with the inner bore 21 of barrel 51 and thus holding the piston 6 in the firing position.

The charge holder 52, whose front part is therefore intended to be engaged in the rear recess of the piston and in which a propulsion gas intake nozzle 19 is provided, has a rear part, for receiving, in a combustion chamber, a propulsive charge 20 intended to be struck by a firing pin carried by the breech of the tool.

An annular ring 22 made from a rigid material, here steel, having an external diameter substantially equal to the internal diameter of spacer 8, is mounted for sliding in this spacer 8. An internal truncated cone shaped bore 23 is formed in ring 22, of a shape complementary to that of the front part 14 of the head of the piston. Between ring 22 and the fastener guide 7 is disposed a first intermediate ring 24, in the form of a sleeve and made from a resilient material, here polyurethane, having an external diameter less than the internal diameter of spacer 8, so as to provide an annular space 32 for expansion thereof, and having an internal diameter greater than the diameter of the rod 12 of the piston. Still between ring 22 and fastener guide 7, but in line with an annular recess 25 formed forward in the fastener guide 7 about the central bore 26 through which rod 12 of the piston passes, and inside ring 24, there is disposed a second intermediate ring 27 also in the form of a sleeve and made from a rigid but slightly deformable material, having an external diameter equal to the internal diameter of the uncompressed ring 24, having an internal diameter slightly greater than the diameter of shank 12 of the piston and having here an axial length equal to that of the uncompressed ring 24.

Ring 27 is here made from steel whose strength is comprised between 500 and 650 $N/m^2$ and whose relative elongation is comprised between 15% and 25%.

Recess 25, in the contemplated embodiment, has a lateral wall slightly in the shape of a truncated cone converging forwardly, for better receiving ring 27 and ensuring a better absorption, furthermore progressive, of the energy in excess, the ring taking the exact shape of the wall of the recess.

A central fastener receiving bore 28 is formed in the fastener guide 7, from its front face 29, having a diameter greater than that of the central bore 26 through which the piston rod passes and into which the central rear bore 26 opens.

The sum of the axial lengths of the rigid ring 22, of the resilient compressed intermediate ring 24 and of the fastener guide 7 is slightly greater than the sum of the axial lengths of the truncated cone shaped part 14 of the head and of the rod 12 of piston 6. Or else, the lengths of all these parts are such that piston 6 cannot project from the fastener guide 7.

The tool having thus been described as far as the structural elements are concerned, we now turn to the operation thereof.

Having introduced a fastener nail 3, 4 through the front face 29 into the bore 28 of the fastener guide 7, the tool is placed against the work piece to be fixed 1. Then, the fastener guide 7, the resilient ring 24, the rigid ring 22 and the barrel 51 through its flange 10 are engaged in pairs and piston 6 is held in barrel 51, by means of its keeper 18, in the firing position, with a charge 20 in the combustion chamber ready to be fired.

Figure 2:
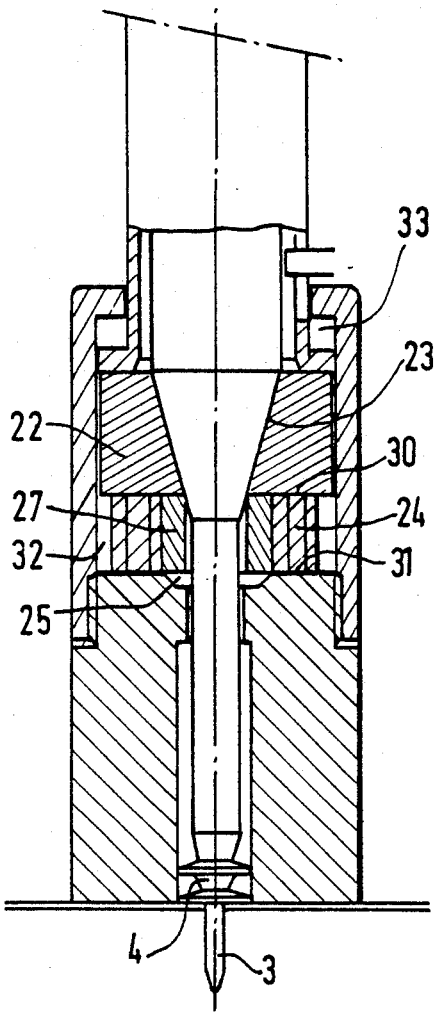
FIG. 2 shows the apparatus of FIG. 1, before compression of the first intermediate resilient ring.
Figure 3:
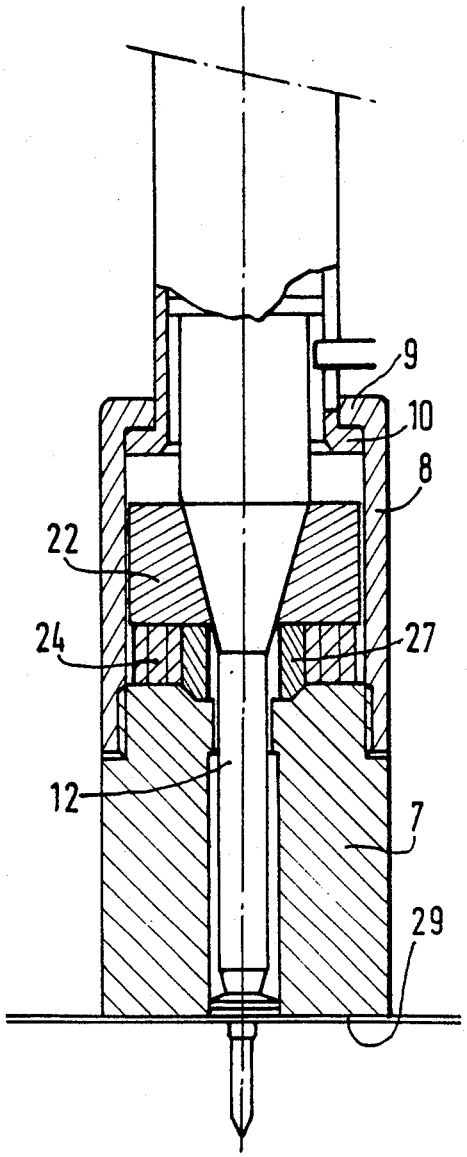
FIG. 3 shows the apparatus of FIG. 1, after firing.

Whether the tool is placed on the work piece to be fixed at a position under which the support is situated, or not, arming of the tool and firing take place quite normally in both cases. Under the action of the propulsion gases, piston 6 is propelled forwardly while driving fastener 4 into the work piece 1; the truncated cone shaped part 14 of the head abuts against the corresponding bore 23 of the rigid ring 22 (FIG. 2). By absorbing a part of the energy, the rigid ring 22 moves forwardly, compressing the resilient ring 24 between the front face 30 of the rigid ring 22 and the rear face 31 of the plug guide 7, the annular space 32, provided around ring 24, allowing expansion of the resilient ring 24, and moving the second deformable intermediate ring 27 into the recess 25 of the rear part of the fastener guide 7 (FIG. 3).

As soon as deformation of the resilient ring 24 is such that its axial dimension has been reduced, at the beginning of use of the tool, by the axial depth of recess 25, and as soon as ring 27 abuts against the bottom of recess 25, for consequently limiting the deformation of ring 24, the residue of energy is transmitted through ring 27 to the fastener guide 7 bearing on work piece 1.

It will be noted that the axial depth of recess 25 and the volume of space 32 are such that, at the end of the step of deformation of the resilient ring 24, when the rigid ring 27 abuts against the bottom of recess 25, the volume of space 32 has been reduced but is not null, by avoiding contact with the annular spacer 8.

It will be noted that during use of the tool, the second rigid intermediate ring 27, under the action of the energy transmitted by the piston, is gradually deformed by compression between the front face 30 of the rigid ring 22 and the bottom of recess 25 of the fastener guide, so that, when the tool is no longer new, the residue of energy is only transmitted to the fastener guide after an axial movement of the rigid ring 22 slightly greater than the depth of recess 25. Of course, there comes a moment when ring 27 is no longer deformed.

It will be further noted that the axial dimension of the intermediate rigid ring 27 could, in the new condition, be smaller than that of the resilient intermediate ring 24, in its uncompressed state, which would avoid having to form recess 25 for receiving ring 27 at the rear of the fastener guide 7.

The fastener guide 7 is then either propelled forwardly if, at the position considered, the support is not situated under the work piece, that is to say if this latter can be deformed under the force, or the whole tool, except in a first stage the fastener guide and the spacer, recoils under the action of the exhaust gases, flange 10 of barrel 51 leaving the rear face of the rigid ring 22 to come into abutment against flange 9 of the spacer 8 (FIG. 3). The purpose of the annular space 33 existing between the two flanges 9 and 10, just before firing, is to permit a relative movement of barrel 51 and of piston 6 and thus to avoid a sudden shock at the time of absorbing the piston, which could cause breakage of the parts by inertia.

After nail 3 has been driven in (FIG. 3) in front end of rod 12 of piston 6 remains recessed with respect to the front face 29 of the fastener guide 7. Even if the apparatus is used for firing, so to speak, into a void, that is to say on a work piece of small thickness to be fixed at a position where it is not applied on its support, the piston remains inside the tool. This is a guarantee of safety and of fixing quality.

A tool has been described having an absorber including a single one piece rigid ring 22 and a single one piece resilient ring 24. Without departing from the scope of the present invention, instead of one, several rigid rings may be provided and, instead of one, several resilient rings may be provided. Similarly, the resilient ring 24 could be not outside but inside the rigid deformable ring 27, and the recess for receiving the rigid ring, when provided for, being of annular shape.

In order to better avoid a brutal shock at the time of absorbing the piston, a resilient ring may be disposed within annular space 33, for example made from polyurethane, of cross-section smaller than that of said space.

During use, ring 22 being possibly submitted to an expansion, its external diameter is preferably slightly smaller to the internal diameter of spacer 8. But, since ring 22 has to be guided, a centering and guiding shoulder will then be provided on the front part of the ring, having an external diameter slightly less or equal to the internal diameter of space 8.

The opening angle of the truncated cone shaped part 14 of the piston head, and of the corresponding bore 23 of ring 22, is advantageously comprised between 13° and 20°, and preferably slightly equal to 15°.

It should also be noted that the axial dimension of the intermediate rigid ring 27, in the new condition, could be greater than that of the intermediate resilient ring 24, in its no compressed condition, provided the rear recess 25 of the fastener guide is consequently dimensioned and allows the axial displacement of ring 27 over a length equal to the reduction of the axial dimension of the resilient ring 24 after compression.

What is claimed is:

1. An indirect firing fastener driving tool, including a piston mounted in a barrel for, under the action of the combustion gases of a propulsive charge, driving a fastener for fixing a work piece on a support, means for absorbing the piston energy being provided between the barrel and a fastener guide disposed in front of the barrel, for absorbing the excess propulsion energy of the piston and limiting its stroke, the absorbing means comprising, in combination, a ring arranged for cooperating with the piston, a first intermediate ring, made from a resilient material, disposed between the ring cooperating with the piston and the fastener guide, and a scond intermediate ring, made from a rigid but slightly deformable material, movable axially between the ring cooperating with the piston and the fastener guide, characterized in that the fastener guide and the second intermediate ring are arranged so the the length of the axial displacement of this second intermediate ring is equal to the maximum reduction of the axial dimension of the first intermediate ring after compression said first and second intermediate rings being concentrically disposed relative to each other.

2. The tool according to claim 1, wherein the fastener guide comprises a rear recess for receiving the second intermediate ring of which the axial depth is at least equal to the reduction of the axial dimension of the first intermediate ring after compression.

3. The tool according to claim 2, wherein the axial dimension of the two intermediate rings is the same prior to driving the fastener.

4. The tool according to claim 1, wherein the ring cooperating with the piston is made from rigid material

5. The tool according to claim 1, wherein an annular space is provided around the two intermediate rings to allow, under the action of displacement of the ring cooperating with the piston, expansion of the first intermediate ring, up to the moment when the second intermediate ring abuts against a rear part of the fastener guide.

6. The tool according to claim 6, wherein the length of the axial displacement of the second intermediate ring and the volume of the space surrounding said first intermediate ring are such that, at the end of the step of deformation of the first intermediate ring, when the second intermediate ring abuts against back bottom of the fastener guide, said volume is not null.

7. The tool according to claim 1, wherein the piston includes a front truncated cone shaped part and the ring cooperating with the piston includes a bore of corresponding shape for receiving the cone shaped part.

8. A fastener driving tool including a piston mounted within a barrel adapted to be driven by a propulsive charge to drive a fastener into a structure, and a fastener guide disposed in front of the barrel, means for damping the piston at the end of a driving stroke to absorb the kinetic energy and limit the stroke, said means including a ring or collar of rigid material disposed to be engaged and moved axially by said piston during the driving stroke, said collar being spaced axially from said fastener guide, first and second rings disposed concentrically within the space between said collar and said fastener guide, one of said first and second rings being a rigid material and the other of resilient material, whereby axial movement of said collar against the first and second rings causes the one of rigid material to move axially into engagement with the fastener guide while the ring of resilient material is compressed axially and expands radially thereby absorbing the energy and limiting the driving stroke.

9. The subject matter of claim 8, wherein the piston and collar are engageable on complimentary frusto-conical surfaces.

10. The subject matter of claim 8, wherein the rigid one of said concentric rings is disposed within the resilient one of said concentric rings.

11. The subject matter of claim 8, wherein said fastener guide has a recess defined therein engageable by the rigid concentric ring.

12. The subject matter of claim 8, wherein said piston includes a rod extending forwardly into said fastener guide for driving a fastener into said structure, said piston rod being sized to not project beyond the end of the fastener guide at the end of the driving stroke.

13. The subject matter of claim 8, wherein said piston includes an end opposite to the frusto-conical portion adjacent to the propulsive charge and against which the charge impacts to drive the piston.

* * * * *